US008104098B1

(12) United States Patent
Kleinert

(10) Patent No.: US 8,104,098 B1
(45) **Date of Patent: *Jan. 31, 2012**

(54) GLOVE WITH DORSAL SIDE KNUCKLE PROTECTIVE PADDING

(75) Inventor: James M. Kleinert, Turners Station, KY (US)

(73) Assignee: Hillerich & Bradsby Co., Louisville, KY (US)

( * ) Notice: Subject to any disclaimer, the term of this patent is extended or adjusted under 35 U.S.C. 154(b) by 285 days.

This patent is subject to a terminal disclaimer.

(21) Appl. No.: 12/403,963

(22) Filed: Mar. 13, 2009

Related U.S. Application Data

(63) Continuation-in-part of application No. 11/132,090, filed on May 18, 2005, now Pat. No. 7,937,773.

(51) Int. Cl.
*A41D 19/00* (2006.01)

(52) U.S. Cl. ..... 2/161.1; 2/159; 2/16

(58) Field of Classification Search ..... 2/158–170, 2/16–21

See application file for complete search history.

(56) References Cited

U.S. PATENT DOCUMENTS

| | | | |
|---|---|---|---|
| 325,968 | A | 9/1885 | Rawlings |
| 385,728 | A | 7/1888 | Sauer |
| RE12,996 | E | 7/1909 | Peach |
| 1,018,271 | A | 2/1912 | Rogers |
| 1,202,705 | A | 10/1916 | Goldsmith et al. |
| 1,435,478 | A | 11/1922 | Kennedy |
| 1,436,131 | A | 11/1922 | Whitley |
| 1,496,824 | A | 6/1924 | Nixon, Jr. |
| 1,525,298 | A | 2/1925 | Hartman |
| 1,552,080 | A | 9/1925 | Rainey |
| 1,562,176 | A | 11/1925 | Latina |
| RE16,272 | E | 2/1926 | Green |
| 1,594,304 | A | 7/1926 | Klahn et al. |
| D072,069 | S | 2/1927 | Meyers |
| 1,716,221 | A | 6/1929 | Fernie |
| 1,841,193 | A | 1/1932 | Lidston |
| 1,900,395 | A | 3/1933 | Gitt, II |
| 2,083,935 | A | 6/1937 | Arnold |
| 2,258,999 | A | 10/1941 | Nunn |

(Continued)

FOREIGN PATENT DOCUMENTS

| | | |
|---|---|---|
| GB | 710394 | 6/1954 |

(Continued)

OTHER PUBLICATIONS

Knecht, Petra: "Funktionstextilien" 2003, Deutscher Fachverlag GMBH, Frankfurt AM Main, XP002473095, pp. 62,63 and pp. 282, 283.

(Continued)

*Primary Examiner* — Shaun R Hurley
*Assistant Examiner* — Andrew Sutton
(74) *Attorney, Agent, or Firm* — Charles G Lamb; Middleton Reutlinger

(57) ABSTRACT

A glove, particularly useful for automobile mechanic work and other types of working environments or sports which brings the dorsal side of the hand in contact with hard objects or the like which may result in injuries to the knuckles of the fingers, thumb and dorsal side of the hand is provided with padding positioned to circumscribe the center axis of rotation of the metacarpalphalangeal joints of the fingers and the thumb. The pad covers the distal ends of the metacarpals and the proximal ends of the proximal phalanxes of the fingers with padding being absent at the metacarpalphalangeal joints of the fingers.

11 Claims, 7 Drawing Sheets

U.S. PATENT DOCUMENTS

| | | | |
|---|---|---|---|
| 2,344,080 | A | 3/1944 | Burgett |
| 2,369,115 | A | 2/1945 | Bloom |
| 2,465,136 | A | 3/1949 | Troccoli |
| 2,528,802 | A | 11/1950 | Turner |
| 2,558,544 | A | 6/1951 | Delsalle |
| 2,636,172 | A | 4/1953 | Stobbe |
| 2,750,594 | A | 6/1956 | Denkert |
| 2,975,429 | A | 3/1961 | Newman |
| 2,980,915 | A | 4/1961 | Peterson |
| 3,042,929 | A | 7/1962 | Kobos |
| 3,096,523 | A | 7/1963 | Bruchas |
| 3,164,841 | A | 1/1965 | Burtoff |
| 3,175,226 | A | 3/1965 | Weinberg |
| 3,273,165 | A | 9/1966 | Sperandeo |
| 3,290,695 | A | 12/1966 | Burtoff |
| 3,300,787 | A | 1/1967 | Denkert |
| 3,411,222 | A | 11/1968 | Williams |
| D213,287 | S | 2/1969 | Khazzam |
| 3,458,867 | A | 8/1969 | Moore et al. |
| 3,532,344 | A | 10/1970 | Masstab |
| 3,564,613 | A | 2/1971 | Fowler |
| 3,576,036 | A | 4/1971 | Latina |
| 3,588,915 | A | 6/1971 | Latina |
| 3,605,117 | A | 9/1971 | Latina |
| 3,606,614 | A | 9/1971 | Dimitroff |
| 3,649,966 | A | 3/1972 | Shields |
| 3,707,730 | A | 1/1973 | Slider |
| 3,918,096 | A | 11/1975 | Lim |
| D240,671 | S | 7/1976 | McTear |
| D240,672 | S | 7/1976 | McTear |
| 3,997,922 | A | 12/1976 | Huhta |
| 3,997,992 | A | 12/1976 | Anderson |
| 4,027,339 | A | 6/1977 | Brucker |
| 4,038,787 | A | 8/1977 | Bianchi |
| 4,042,975 | A | 8/1977 | Elliott, Jr. et al. |
| 4,051,552 | A | 10/1977 | Widdemer |
| 4,051,553 | A | 10/1977 | Howard |
| 4,067,063 | A | 1/1978 | Ettinger |
| 4,068,312 | A | 1/1978 | Ledesma |
| 4,084,584 | A | 4/1978 | Detty |
| 4,095,292 | A | 6/1978 | Klein |
| D248,898 | S | 8/1978 | DeLeone et al. |
| 4,137,572 | A | 2/1979 | Jansson et al. |
| 4,187,557 | A | 2/1980 | Tombari |
| 4,201,203 | A | 5/1980 | Applegate |
| 4,250,578 | A | 2/1981 | Barlow |
| 4,272,849 | A | 6/1981 | Thurston et al. |
| 4,272,850 | A | 6/1981 | Rule |
| 4,287,885 | A | 9/1981 | Applegate |
| 4,329,741 | A | 5/1982 | Bach |
| 4,346,481 | A | 8/1982 | Latina |
| 4,438,532 | A | 3/1984 | Campanella et al. |
| 4,445,507 | A | 5/1984 | Eisenberg |
| 4,524,464 | A | 6/1985 | Primiano et al. |
| 4,546,495 | A | 10/1985 | Castillo |
| 4,561,122 | A | 12/1985 | Stanley et al. |
| 4,570,269 | A | 2/1986 | Berlese |
| 4,589,146 | A | 5/1986 | Taylor |
| 4,590,625 | A | 5/1986 | Keim |
| 4,630,318 | A | 12/1986 | Aoki |
| 4,663,783 | A | 5/1987 | Obayashi |
| 4,665,561 | A | 5/1987 | Aoki |
| 4,677,698 | A | 7/1987 | Angas |
| 4,684,123 | A | 8/1987 | Fabry |
| 4,691,387 | A | 9/1987 | Lopez |
| 4,700,404 | A | 10/1987 | Potvin |
| D294,984 | S | 3/1988 | Green |
| 4,747,163 | A | 5/1988 | Dzierson |
| 4,748,690 | A | 6/1988 | Webster |
| 4,751,749 | A | 6/1988 | Cowhey |
| 4,766,612 | A | 8/1988 | Patton, Sr. |
| 4,815,147 | A | 3/1989 | Gazzano et al. |
| 4,847,915 | A | 7/1989 | Keene |
| 4,850,053 | A | 7/1989 | Tepley et al. |
| 4,864,659 | A | 9/1989 | Morris |
| 4,864,660 | A | 9/1989 | Sawyer |
| 4,891,845 | A | 1/1990 | Hayes |
| 4,896,376 | A | 1/1990 | Miner |
| 4,911,433 | A | 3/1990 | Walker et al. |
| 4,930,162 | A | 6/1990 | Côté |
| 4,958,384 | A | 9/1990 | McCrane |
| 4,967,418 | A | 11/1990 | Marcotte |
| 5,004,227 | A | 4/1991 | Hoffman |
| 5,016,286 | A | 5/1991 | Henriksen |
| 5,028,050 | A | 7/1991 | Freyer |
| 5,031,238 | A | 7/1991 | Hayes |
| 5,058,209 | A | 10/1991 | Eisenberg |
| 5,067,175 | A | 11/1991 | Gold |
| 5,083,361 | A | 1/1992 | Rudy |
| 5,107,544 | A | 4/1992 | Capatosto |
| D328,369 | S | 7/1992 | Hong |
| 5,136,725 | A | 8/1992 | Montero |
| 5,146,624 | A | 9/1992 | Brückner |
| 5,168,576 | A | 12/1992 | Krent et al. |
| 5,168,578 | A | 12/1992 | Stanley |
| D332,845 | S | 1/1993 | Johnston |
| 5,175,886 | A | 1/1993 | Suk |
| 5,195,188 | A | 3/1993 | Bourdeau et al. |
| 5,214,799 | A | 6/1993 | Fabry |
| 5,218,718 | A | 6/1993 | Chih |
| 5,218,719 | A | 6/1993 | Johnson |
| D338,280 | S | 8/1993 | Krent et al. |
| 5,237,703 | A | 8/1993 | Brine et al. |
| 5,253,365 | A | 10/1993 | Clevenhagen |
| 5,257,418 | A | 11/1993 | Jaskiewicz |
| 5,309,573 | A | 5/1994 | Solar et al. |
| 5,323,490 | A | 6/1994 | Yarbrough |
| 5,328,652 | A | 7/1994 | Thomson |
| 5,329,639 | A | 7/1994 | Aoki |
| 5,330,391 | A | 7/1994 | Mitchell |
| 5,345,609 | A | 9/1994 | Fabry et al. |
| 5,379,460 | A | 1/1995 | Aoki |
| D356,203 | S | 3/1995 | Mitch |
| D360,284 | S | 7/1995 | Paffett et al. |
| 5,435,008 | A | 7/1995 | Shane |
| 5,442,815 | A | 8/1995 | Cordova et al. |
| 5,442,816 | A | 8/1995 | Seketa |
| 5,459,878 | A | 10/1995 | Gold |
| 5,462,280 | A | 10/1995 | Dickerson |
| 5,471,682 | A | 12/1995 | Robins et al. |
| 5,477,558 | A | 12/1995 | Völker et al. |
| 5,488,739 | A | 2/1996 | Cardinal |
| 5,490,290 | A | 2/1996 | Gold |
| 5,500,955 | A | 3/1996 | Gongea |
| 5,511,242 | A | 4/1996 | Bianchi |
| 5,511,243 | A | 4/1996 | Hall et al. |
| 5,511,244 | A | 4/1996 | Shikatani |
| 5,530,967 | A | 7/1996 | Cielo |
| 5,551,083 | A | 9/1996 | Goldsmith |
| 5,557,803 | A | 9/1996 | Granich et al. |
| 5,564,122 | A | 10/1996 | Wagner |
| 5,575,005 | A | 11/1996 | Walker et al. |
| 5,581,809 | A | 12/1996 | Mah |
| 5,592,688 | A | 1/1997 | LaRonge et al. |
| 5,598,582 | A | 2/1997 | Andrews et al. |
| 5,600,853 | A | 2/1997 | Yewer, Jr. |
| 5,608,912 | A | 3/1997 | Cumberland |
| 5,608,915 | A | 3/1997 | Libit |
| 5,634,214 | A | 6/1997 | St. Ville |
| 5,638,548 | A | 6/1997 | Kawakami |
| 5,640,712 | A | 6/1997 | Hansen et al. |
| 5,644,795 | A | 7/1997 | Landis et al. |
| 5,655,221 | A | 8/1997 | Worischeck |
| 5,655,226 | A | 8/1997 | Williams |
| 5,659,897 | A | 8/1997 | Satoh |
| D385,667 | S | 10/1997 | Goldsmith |
| 5,675,839 | A | 10/1997 | Gordon et al. |
| 5,678,245 | A | 10/1997 | Rector et al. |
| 5,682,613 | A | 11/1997 | Dinatale |
| 5,685,014 | A | 11/1997 | Dapsalmon |
| 5,692,242 | A | 12/1997 | Tekerman et al. |
| 5,694,642 | A | 12/1997 | Rector et al. |
| 5,697,103 | A | 12/1997 | Wiggins |
| 5,697,104 | A | 12/1997 | Welton |
| D389,283 | S | 1/1998 | Goldsmith |
| 5,708,979 | A | 1/1998 | Redwood et al. |
| 5,715,539 | A | 2/1998 | Benecki et al. |

5,717,994 A 2/1998 Goldsmith
5,717,995 A 2/1998 Murai
5,720,047 A 2/1998 Spitzer
5,745,916 A 5/1998 Linner
5,761,745 A 6/1998 Sato
5,781,929 A 7/1998 Shikatani
5,781,931 A 7/1998 Lee
5,785,617 A 7/1998 MacKay, Jr.
5,787,506 A 8/1998 Wilder et al.
5,790,980 A 8/1998 Yewer, Jr.
5,799,327 A 9/1998 Clevenhagen
5,802,614 A 9/1998 Melone, Jr.
5,806,092 A 9/1998 Shikatani
5,809,571 A 9/1998 Spitzer
5,815,839 A 10/1998 Safford
5,815,840 A 10/1998 Hamlin
5,819,312 A 10/1998 Snyder et al.
5,855,022 A 1/1999 Storto
5,878,436 A 3/1999 Jones
5,884,329 A 3/1999 Goldsmith et al.
5,887,282 A 3/1999 Lenhart
5,893,172 A 4/1999 Haynes et al.
5,898,938 A 5/1999 Baylor et al.
5,898,942 A 5/1999 Anderson
5,926,847 A 7/1999 Eibert
5,946,720 A 9/1999 Sauriol
5,963,985 A 10/1999 Behr et al.
5,983,396 A 11/1999 Morrow et al.
5,987,642 A 11/1999 Webster
5,987,646 A * 11/1999 Bolmer ..... 2/161.1
D417,757 S 12/1999 Aoki
5,996,117 A 12/1999 Goldsmith et al.
6,000,059 A 12/1999 Abts
6,006,751 A 12/1999 Spitzer
6,012,170 A 1/2000 Kim
6,016,571 A 1/2000 Guzman et al.
D420,173 S 2/2000 Aoki
D420,174 S 2/2000 Aoki
D420,202 S 2/2000 Redwood et al.
6,035,443 A 3/2000 Green
6,041,438 A 3/2000 Kirkwood
6,049,910 A 4/2000 McCarter
6,052,827 A 4/2000 Widdemer
6,065,150 A 5/2000 Huang
D426,922 S 6/2000 Redwood et al.
6,085,352 A 7/2000 Martin
6,088,835 A 7/2000 Perkins et al.
6,098,200 A 8/2000 Minkow et al.
6,105,162 A 8/2000 Douglas et al.
6,122,769 A 9/2000 Wilder et al.
D431,691 S 10/2000 Redwood et al.
6,182,289 B1 2/2001 Brown
6,185,747 B1 2/2001 Hughes
6,216,276 B1 4/2001 Eibert
6,223,350 B1 5/2001 McFarlane
6,223,744 B1 5/2001 Garon
6,226,795 B1 5/2001 Winningham
6,233,744 B1 5/2001 McDuff
6,249,915 B1 6/2001 Hang
6,253,382 B1 7/2001 Kleinert
6,256,792 B1 7/2001 MacDonald
D445,996 S 8/2001 Kiernan
6,275,996 B1 8/2001 Redwood et al.
6,279,160 B1 8/2001 Chen
6,279,163 B1 8/2001 Hale et al.
6,289,515 B1 9/2001 Fous
6,289,516 B1 9/2001 Motooka et al.
6,321,387 B1 11/2001 Fukae
6,353,931 B1 3/2002 Gilligan et al.
6,378,925 B1 4/2002 Greenlee
6,389,601 B2 5/2002 Kleinert
6,405,380 B1 6/2002 Kuroda et al.
6,415,444 B1 7/2002 Kleinert
6,415,445 B1 7/2002 Nishijima et al.
D461,621 S 8/2002 Bevier
6,427,247 B1 8/2002 Suk
6,430,745 B2 8/2002 Murai
D462,922 S 9/2002 Yuan et al.
6,453,474 B2 9/2002 Kleinert
D464,178 S 10/2002 Redwood et al.
6,460,184 B1 10/2002 Nishimura et al.
6,487,724 B1 12/2002 Aoki
D468,075 S 1/2003 Votel
6,502,244 B1 1/2003 Kleinert
6,516,470 B1 2/2003 Aoki
6,516,471 B1 2/2003 Baumann
6,519,781 B1 2/2003 Berns
D471,343 S 3/2003 Sun
D471,674 S 3/2003 Redwood et al.
6,526,592 B1 3/2003 Best
6,536,046 B1 3/2003 Gilligan
D474,863 S 5/2003 Sun
D474,963 S 5/2003 Gersten et al.
6,571,394 B1 6/2003 Hackett et al.
6,584,616 B2 7/2003 Godshaw et al.
6,618,860 B1 9/2003 Sullivan et al.
6,651,255 B1 11/2003 Schild
6,662,942 B1 12/2003 Bonzagni
6,668,379 B2 12/2003 Kleinert
6,681,402 B1 1/2004 Bevier et al.
6,701,530 B2 3/2004 Kleinert
6,704,939 B2 3/2004 Faulconer
6,708,346 B2 3/2004 Terris et al.
6,715,152 B2 4/2004 Mazzarolo
6,721,960 B1 4/2004 Levesque et al.
6,732,377 B1 5/2004 Wilkinson
6,745,402 B2 6/2004 Caswell
6,760,923 B1 7/2004 Tate
6,760,924 B2 7/2004 Hatch et al.
D495,097 S 8/2004 Redwood et al.
6,775,847 B2 8/2004 Terris et al.
D499,529 S 12/2004 Kleinert
D499,856 S 12/2004 Kleinert
6,845,514 B1 1/2005 Yao
6,845,519 B2 1/2005 Garneau
6,862,744 B2 3/2005 Kuroda et al.
6,961,960 B2 11/2005 Gold et al.
D513,828 S 1/2006 Bevier
D514,772 S 2/2006 Bevier
7,000,256 B2 2/2006 Kleinert
7,000,257 B2 2/2006 Bevier
D516,277 S 3/2006 Mattesky
D529,236 S 9/2006 Litke et al.
7,100,212 B2 9/2006 Jaeger
D532,162 S 11/2006 Bonzagni et al.
7,171,696 B2 2/2007 Falone et al.
D545,002 S 6/2007 Voravan et al.
D549,398 S 8/2007 Swartz et al.
D554,808 S 11/2007 Litke et al.
D570,056 S 5/2008 Metcalf
7,406,719 B2 8/2008 Aoki
D581,102 S 11/2008 Faulconer
D583,527 S 12/2008 Kleinert
D583,528 S 12/2008 Kleinert
7,464,446 B2 12/2008 Johansson
D584,026 S 1/2009 Kleinert
7,578,006 B2 8/2009 Garneau
7,707,653 B2 5/2010 Kleinert
2001/0025382 A1 10/2001 Murai
2001/0054190 A1 12/2001 Kleinert
2002/0013961 A1 2/2002 Kleinert
2002/0040494 A1 4/2002 Kleinert
2002/0042940 A1 4/2002 Kuroda et al.
2002/0152536 A1 10/2002 Kuroda et al.
2003/0005506 A1 1/2003 Like
2003/0050586 A1 3/2003 Domanski et al.
2003/0051285 A1 3/2003 Bower
2003/0056273 A1 3/2003 Kleinert
2003/0061651 A1 4/2003 DeRose, Sr.
2003/0205232 A1 11/2003 Spitzer
2004/0016038 A1 1/2004 Motooka et al.
2004/0025226 A1 2/2004 Jaeger
2004/0025227 A1 2/2004 Jaeger
2004/0103465 A1 6/2004 Kleinert
2004/0107476 A1 6/2004 Goldwitz
2004/0111786 A1 6/2004 Terris et al.
2004/0123371 A1 7/2004 Bryant, Sr.
2004/0216207 A1 11/2004 Anderson

| | | | |
|---|---|---|---|
| 2004/0221365 | A1 | 11/2004 | Fitzgerald |
| 2005/0034213 | A1 | 2/2005 | Bamber |
| 2005/0114982 | A1 | 6/2005 | Gremmert |
| 2006/0026738 | A1 | 2/2006 | Kleinert |
| 2006/0137067 | A1 | 6/2006 | Wu |
| 2006/0195968 | A1 | 9/2006 | Powell et al. |
| 2007/0061943 | A1 | 3/2007 | Kleinert |
| 2007/0150998 | A1 | 7/2007 | Atherton |
| 2007/0150999 | A1 | 7/2007 | Brown |
| 2007/0209097 | A1 | 9/2007 | Iacullo |
| 2008/0052799 | A1 | 3/2008 | Yoo |
| 2008/0060115 | A1 | 3/2008 | Morris |
| 2008/0141435 | A1 | 6/2008 | Friedman |
| 2009/0139010 | A1 | 6/2009 | Bevier |

FOREIGN PATENT DOCUMENTS

| | | |
|---|---|---|
| JP | 09182825 | 7/1997 |
| JP | 02003020504 | 1/2003 |
| WO | WO-9716085 | 5/1997 |
| WO | WO-03082036 | 10/2003 |

OTHER PUBLICATIONS

Anonymous: "Sportco Source" Internet Article, [Online] Apr. 27, 2006, XP002473014, Retrieved from the Internet: URL: http://web.archive.org/web/20060427131931/http://www.sportco-int.com/baseballgloves.htm> [retrieved on Mar. 17, 2008], p. 9.

Anonymous: "The Coolmax Golf Glove", Internet Article, [Online] Aug. 29, 2006, XP002473015, Retrieved from the Internet: URL: http://web.archive.org/web/20060829123241/http://www.hsc.csu.edu.au/textiles_design/performance/2795/glove.htm> [retrieved on Mar. 17, 2008] the whole document.

European Patent Office (ISA/EP); International Search Report and Written Opinion of the International Searching Authority, or the Declaration; Apr. 10, 2008; pp. 1-20; PCT/US2007/023054; European Patent Office; the Netherlands.

United States Patent and Trademark Office (ISA/US); International Search Report and Written Opinion of the International Searching Authority, or the Declaration; May 9, 2005; pp. 1-8; PCT/US04/31316; U.S. Patent and Trademark Office; USA.

European Patent Office (ISA/EP); International Search Report and Written Opinion of the International Searching Authority, or the Declaration; Apr. 13, 2007; pp. 1-8; PCT/US2006/038290; European Patent Office; the Netherlands.

European Patent Office (ISA/EP); International Search Report and Written Opinion of the International Searching Authority, or the Declaration; Jan. 23, 2008; pp. 1-12; PCT/US2007/017302; European Parent Office; the Netherlands.

United States Patent and Trademark Office (ISA/US); International Search Report of the International Searching Authority; Jul. 17, 2003; pp. 1-5; PCT/US03/09409; U.S. Patent and Trademark Office; USA.

European Patent Office (ISA/EP); International Search Report; Jun. 22, 2001; pp. 1-3; PCT/US2001/02608; European Patent Office; the Netherlands.

United States Patent and Trademark Office (ISA/US); International. Search Report of the International Searching Authority; Apr. 23, 2003; pp. 1-3; PCT/US02/19390; U.S. Patent and Trademark Office; USA.

United States Patent and Trademark Office (ISA/US); International Search Report of the International Searching Authority; Apr. 7, 2005; pp. 1-3; PCT/US03/41488; U.S. Patent and Trademark Office; USA.

* cited by examiner

GLOVE WITH DORSAL SIDE KNUCKLE PROTECTIVE PADDING

CROSS-REFERENCE TO RELATED APPLICATION

This continuation-in-part application claims priority to and benefit from, currently pending, U.S. patent application Ser. No. 11/132,090 filed on May 18, 2005 entitled "Glove with Dorsal Side Knuckle Protective Padding".

BACKGROUND OF THE INVENTION

1. Field of the Invention

This invention relates to gloves for the human hand and specifically gloves to protect the dorsal side knuckle areas of the hand. More particularly, this invention relates to a glove which is useful for playing sports or in work wherein padding is provided to protect the dorsal side knuckle areas of the hand with minimum restriction of movement of the metacarpal-phalangeal joints of the fingers and the thumb.

2. Description of Related Art

Glove construction for protection of the human hand is well known. For example, U.S. Pat. No. 3,175,226 teaches a dress glove construction which completely covers the fingers and which includes resiliently expandable materials in selected areas to accommodate hands of different sizes. In contrast, U.S. Pat. No. 4,561,122 teaches a protective glove which has a wraparound construction for a protective glove which leaves the thumb and finger ends exposed. U.S. Pat. No. 5,345,609 teaches a protective glove which includes shock absorbing cells disposed at selected portions along the top of the glove. U.S. Pat. No. 5,790,980 teaches a hand glove with a polyurethane foam pad in the palm portion of the glove. U.S. Pat. No. 1,149,139 teaches a grip golf glove and includes a plurality of ventilating apertures which are positioned over or adjacent to the individual knuckles of each finger. U.S. Pat. No. 4,094,014 is directed to a workman's glove and teaches knuckle protecting surfaces which are added along a protective-hand enclosing sheet which is preferably porous and of rubber cloth or filamentary mesh with a plurality of knuckle protecting cushion pads disposed along the top rear surface of the glove and a transverse pad covers the knuckles on the back of the hand. Moreover, there are a number of patents for gloves which teach protection of the boney prominence areas of the hand. Although hand protection from direct shocks and abrasions is found in gloves with the current art, what is needed is a glove which provides protection for the dorsal side knuckle area of the hand while minimizing interference with the rotation of the metacarpalphalangeal joints of the fingers and thumb.

SUMMARY OF THE INVENTION

An object of the present invention is to provide a glove which protects the dorsal side knuckle area of the hand without unduly restriction of the metacarpalphalangeal joints of the fingers and thumb.

Another object of the present invention is to provide a glove for a human hand which may be useful in the playing of sports or in selected work environments wherein the knuckle areas of the hand are subjected to endeavors which may be injurious to the knuckles area of the hand.

A further object of the present invention is to provide a work glove particularly for use in work areas where the wearer is constantly abrading or subjecting the knuckle area to contact with work pieces such as, for example, an automobile engine or the like.

More particularly, the present invention provides a glove for protection of the dorsal side knuckle area of the hand. The glove is provided with a covering for the hand with separate elongated sections to receive a plurality of fingers therein. A first protective pad is attached along a dorsal side of the covering and is located below the center axis of rotation of the metacarpalphalangeal joint of the fingers. A second protective pad is attached to the dorsal side of the covering and is located above the center axis of rotation of the metacarpal-phalangeal joints of the fingers. There is an absence of padding at the metacarpalphalangeal joints of the fingers.

Further objects and advantages of this invention will appear from the following description and appended claims, reference being had to the accompanying drawings forming a part of the specification and in like reference characters which designate corresponding parts in the several views.

DESCRIPTION OF THE PREFERRED EMBODIMENT

Figure 1:
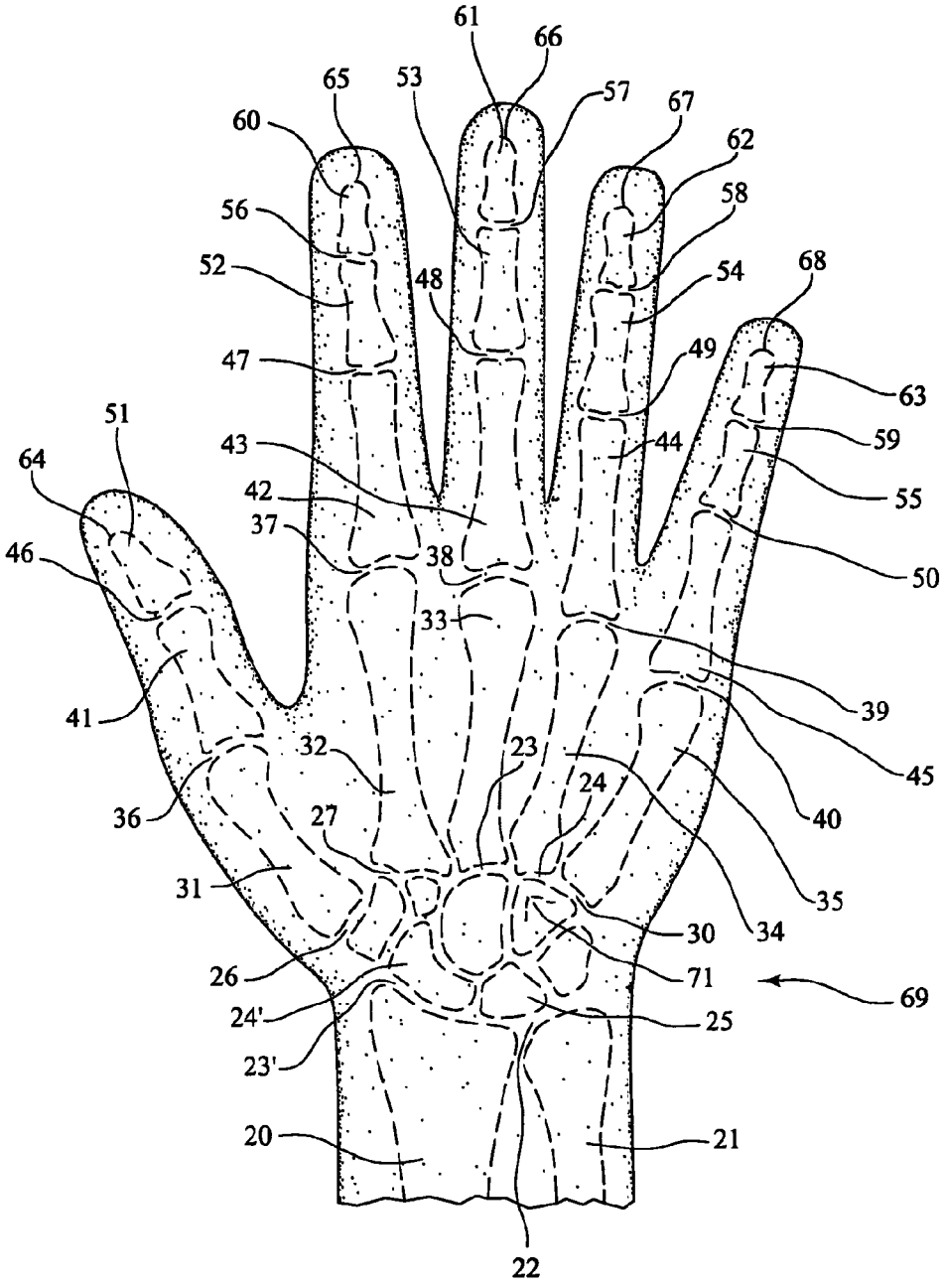
FIG. 1 is a top schematic anatomical skeletal structure of a right side human hand showing a dorsal-side detail.

FIG. 1 is a schematic anatomical view of the skeletal structure of the dorsal side of a right human hand 10. Shown are the radius 20, ulna 21, radio carpal joint (RC) 23', distal radio ulnar joint (DRUJ) 22, thumb 64, index finger 65, long finger 66, ring finger 67, and small or little finger 68. The carpus 69 comprises eight carpal bones, seven of which are shown in FIG. 1 and includes the hamate bone 71 with its hook-like protrusion, the scaphoid 24' and the lunate 25.

The thumb 64 is comprised of the distal phalanx 51, the interphalangeal joint (IP) 46, proximal phalanx 41, diaphysis of proximal phalanx 41', metacarpalphalangeal joint (MCP) 36, metacarpal 31, and carpometacarpal joint (CMC) 26.

The index finger 65 is comprised of the distal phalanx 60, distal interphalangeal joint (DIP) 56, middle phalanx 52, proximal interphalangeal joint (PIP) 47, proximal phalanx 42, metacarpalphalangeal joint (MCP) 37, metacarpal 32, and carpometacarpal joint (CMC) 27.

The long finger 66 is comprised of the distal phalanx 61, distal interphalangeal joint (DIP) 57, middle phalanx 53, proximal interphalangeal joint (PIP) 48, proximal phalanx 43, metacarpalphalangeal joint (MCP) 38, metacarpal 33, and carpometacarpal joint (CMC) 23.

The ring finger 67 is comprised of the distal phalanx 62, distal interphalangeal joint (DIP) 58, middle phalanx 54, proximal interphalangeal joint (PIP) 49, proximal phalanx 44, metacarpalphalangeal joint (MCP) 39, metacarpal 34, and carpometacarpal joint (CMC) 24.

The small or little finger 68 is comprised of the distal phalanx 63, distal interphalangeal joint (DIP) 59, middle phalanx 55, proximal interphalangeal joint (PIP) 50, proximal phalanx 45, metacarpalphalangeal joint (MCP) 40, metacarpal 35, and carpometacarpal joint (CMC) 30.

Figure 2:
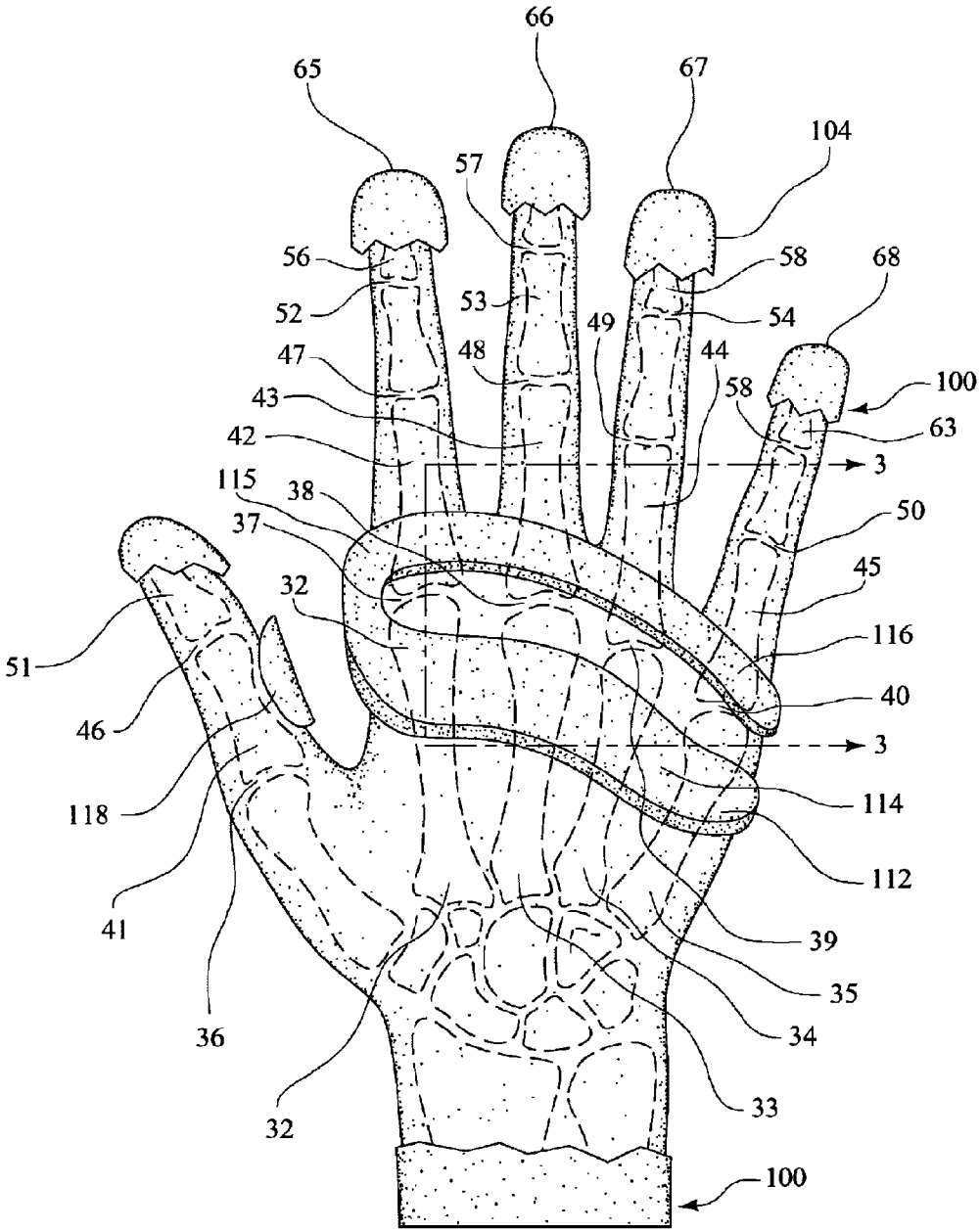
FIG. 2 is a top view showing the positioning for padding of a preferred glove of the present invention showing the dorsal-side detail and seen overlapping the skeletal structure of FIG. 1.
Figure 6:
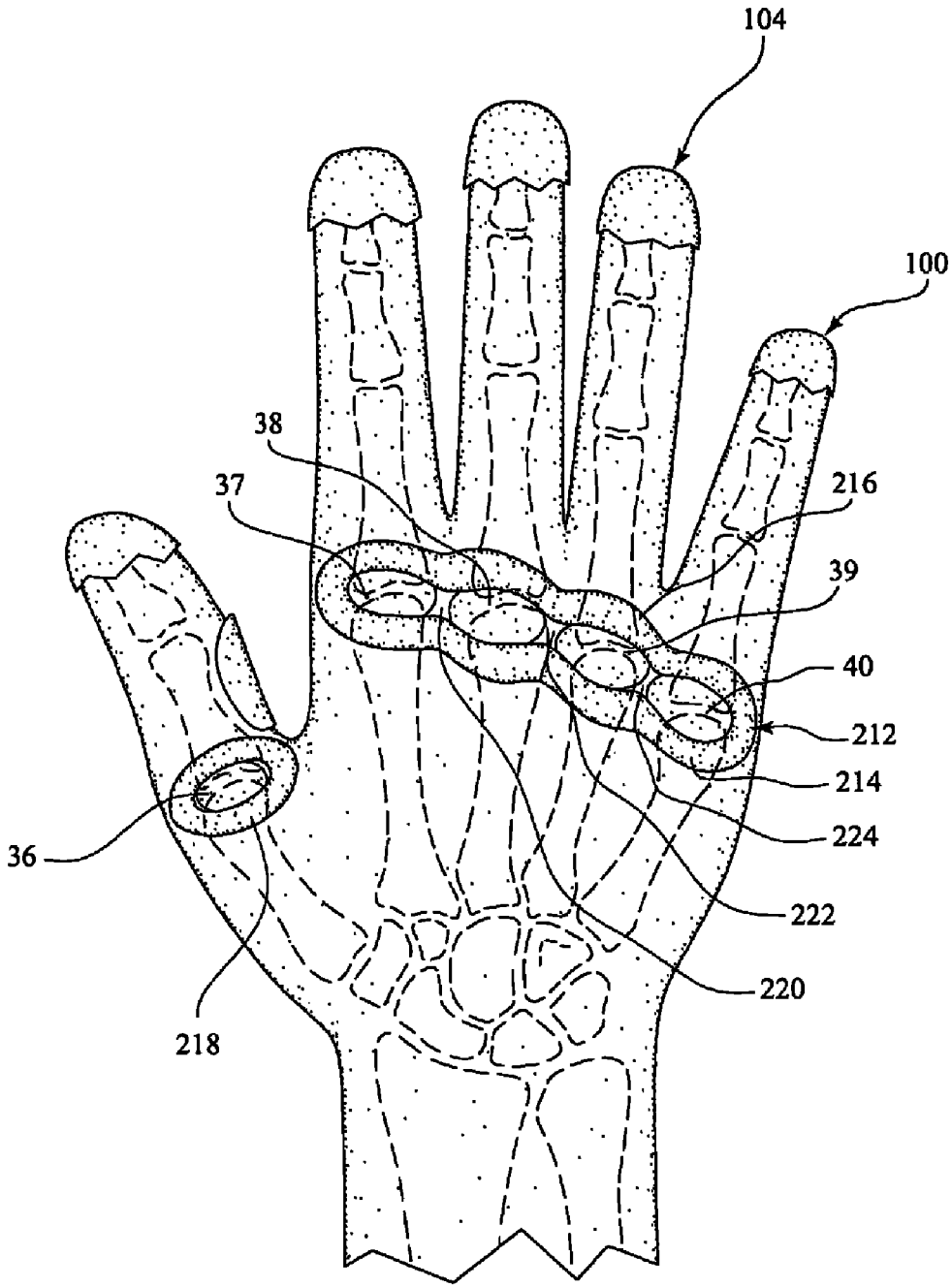
FIG. 6 is a top view showing the positioning of padding of another preferred glove of the present invention showing the dorsal-side detail and seen overlaying the skeletal structure of FIG. 1.
Figure 7:
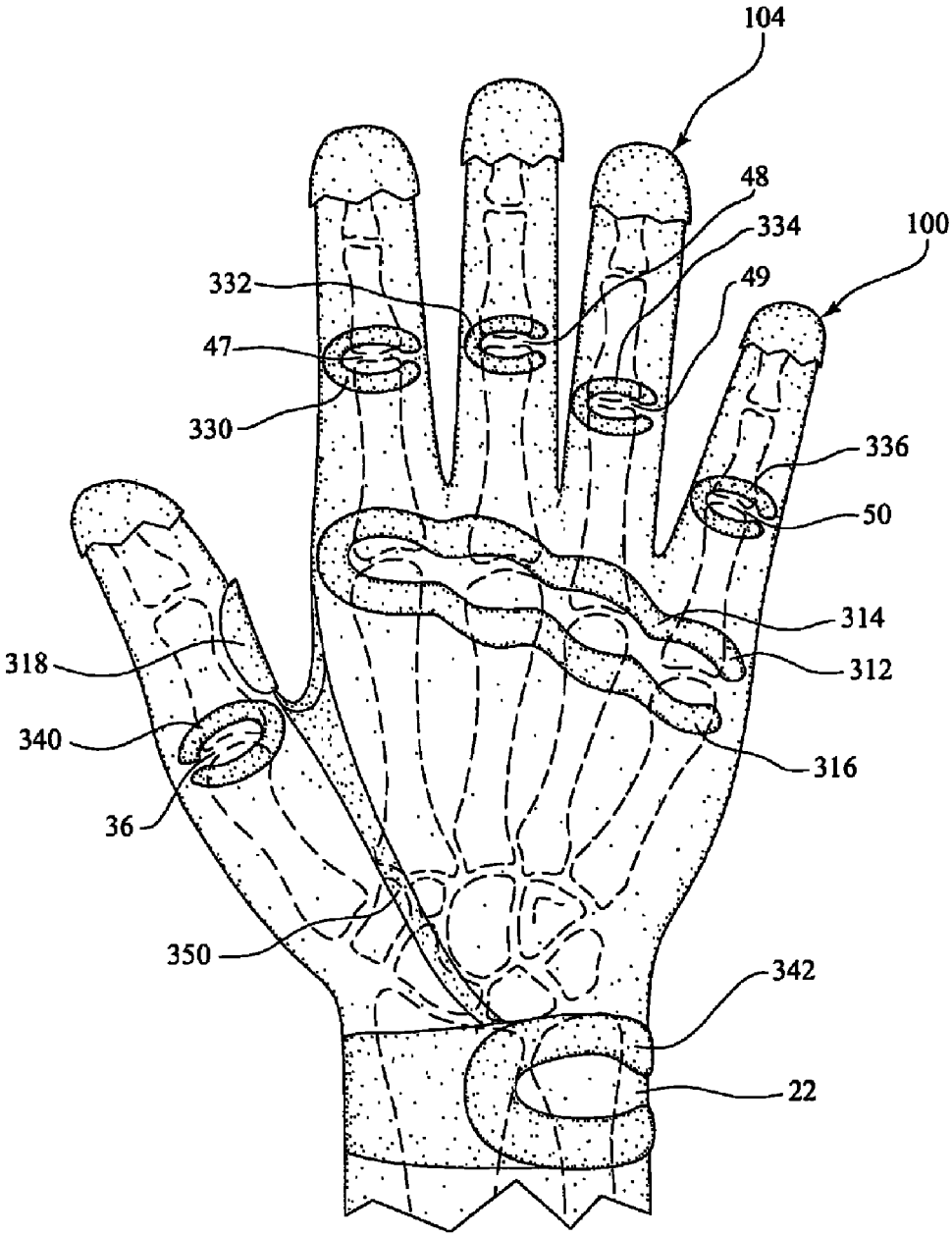
FIG. 7 is a top view showing the positioning for padding of even another preferred glove of the present invention showing the dorsal-side detail and seen overlaying the skeletal structure of FIG. 1.

In FIGS. 2, 6 and 7 are three embodiments showing the positioning of padding of the present invention overlaying the skeletal structure of the dorsal side of the human hand. These FIGS. show only a right hand but it is realized that a left hand utilizes symmetrical placement of the padding, materials, thicknesses and the like herein described.

Figure 4:
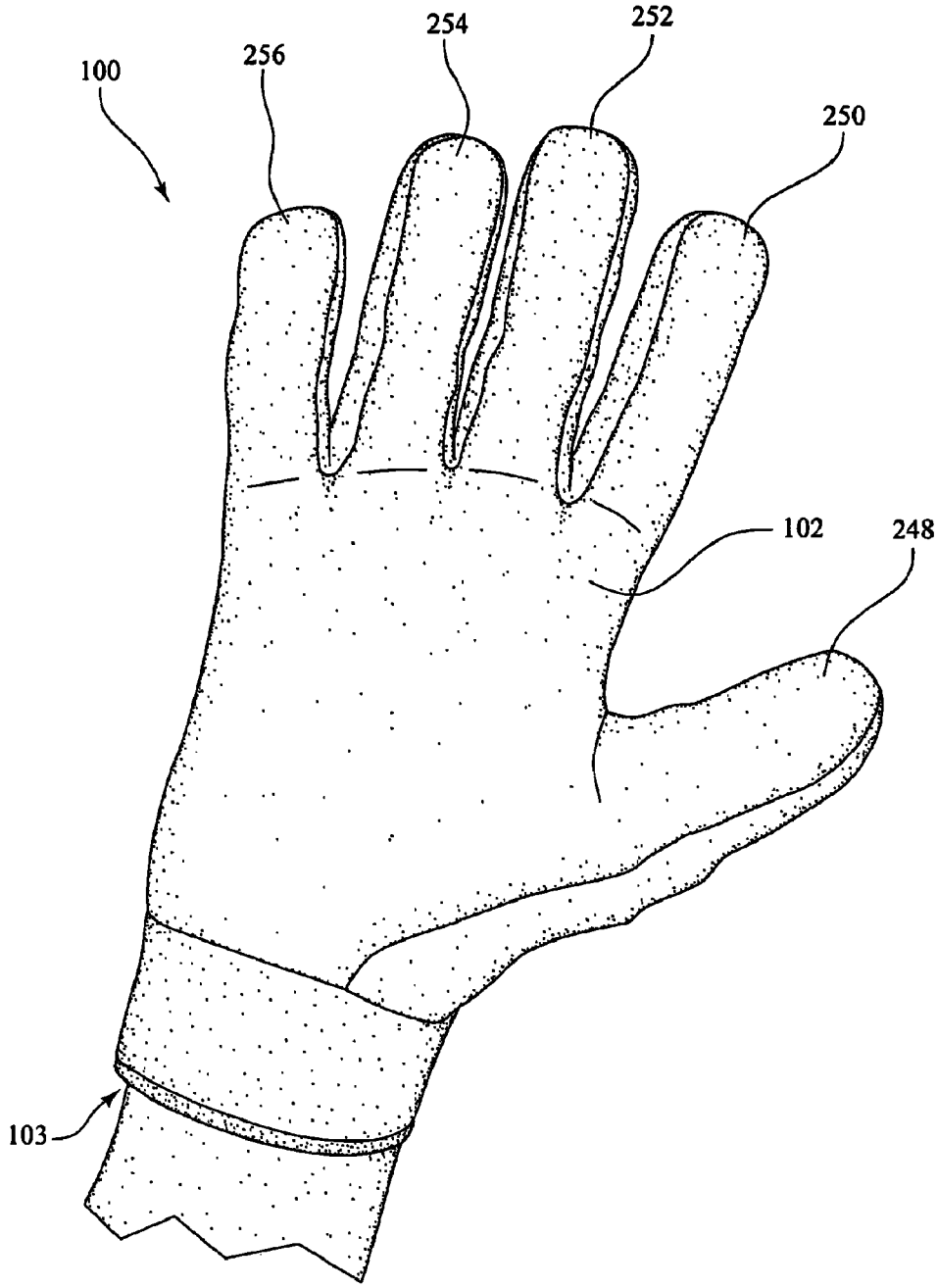
FIG. 4 is a perspective view of the preferred embodiment of the glove of the present invention showing the palm-side of the glove.
Figure 5:
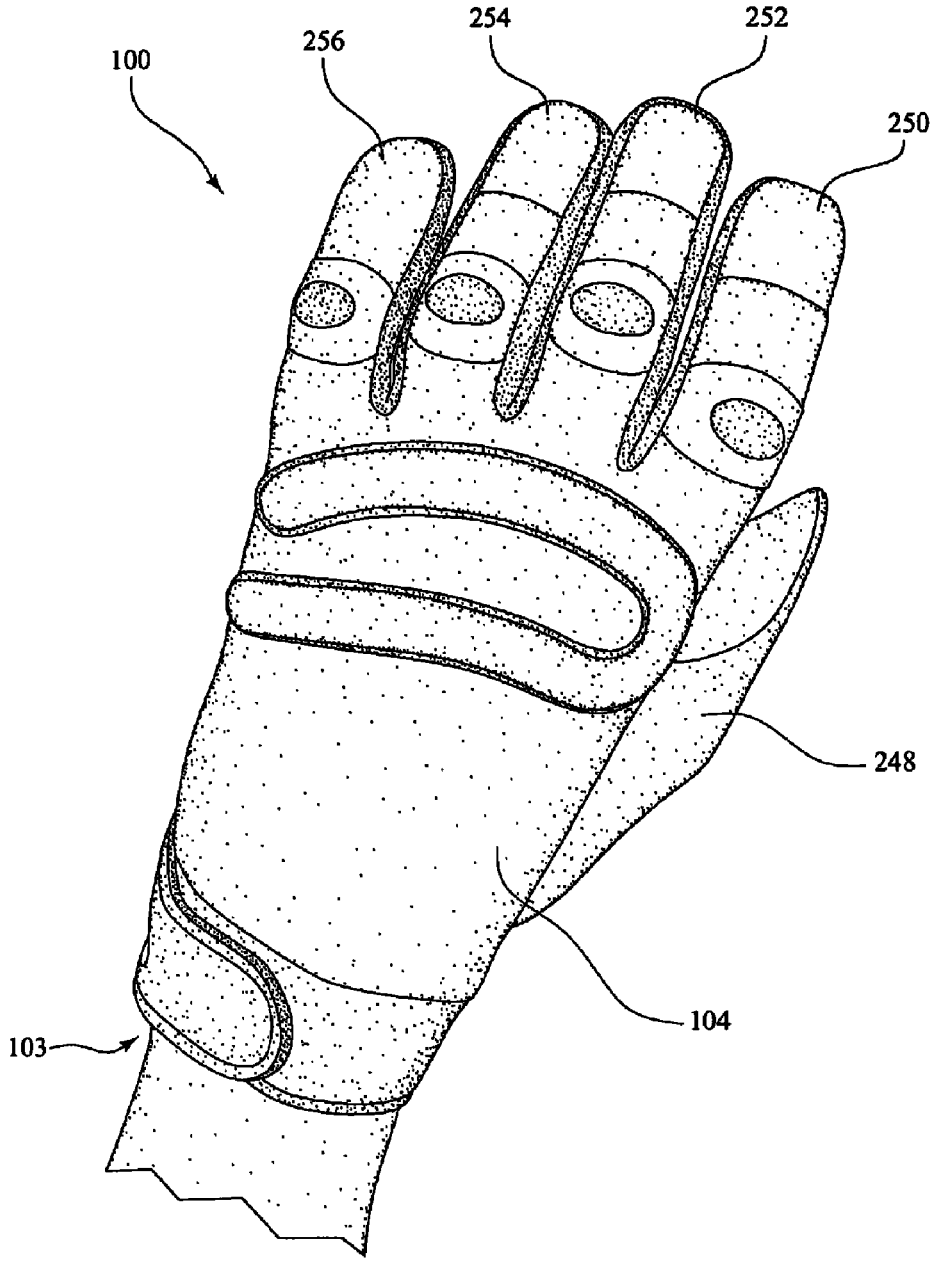
FIG. 5 is a perspective view of the preferred embodiment of the glove of the present invention showing the dorsal-side of the glove.

As best shown in FIGS. 4 and 5, a preferred glove 100, particular useful as a work glove, such as those used by auto mechanics which are constantly being rubbed and "banged" against metal parts of an automobile engine, is provided for the right human hand. The glove 100 includes a palmer side panel 102 and a dorsal side panel 104. The two panels are generally stitched or otherwise attached along their outer periphery and define a plurality of finger stalls and a thumb stall. The finger stalls are identified by the numerals 250 for the index finger, 252 for the long finger, 254 for the ring finger and 256 for the small finger. The thumb stall is identified as 248. The glove 100 is also provided with an opening 103 to receive the human hand therein. The glove panels 102, 104 are made of any suitable material known in the art, such as leather, or the like.

Figure 3:
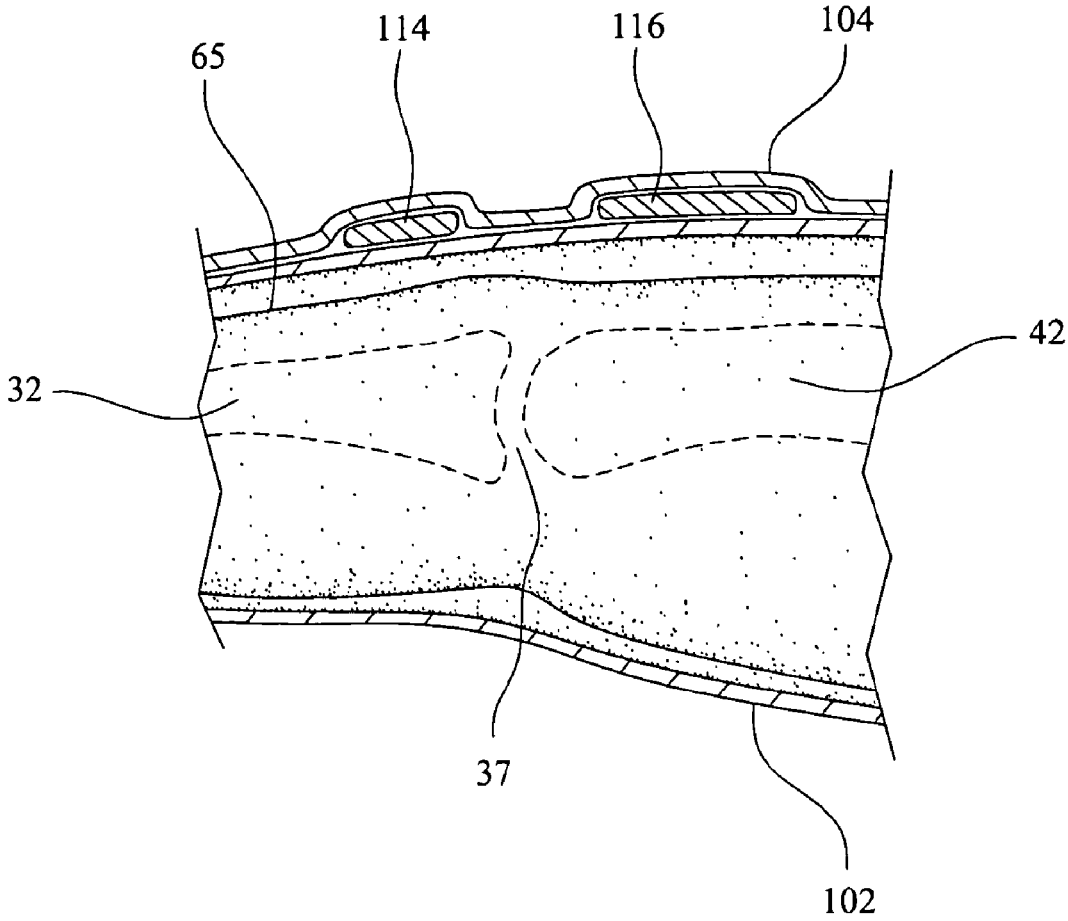
FIG. 3 is a cut-away section taken along line 3-3 of FIG. 2.

As best shown in FIGS. 2 and 3, the top portion of the dorsal side panel 104 covers a U-shaped pad 112 which includes a first transversely extending pad portion 114 and a substantially parallel second transversely extending second pad portion 116 with a longitudinally extending connecting pad 115. The first pad portion 114 extends along the dorsal side of the distal end of the metacarpals 32, 33, 34 and 35 of the index finger 65, long finger 66, ring finger 67 and small finger 68, respectively. The first pad 114 and the second pad portion 116 are positioned so that the center axis of rotation of the metacarpalphalangeal joints 37, 38, 39 and 40 of the index finger 65, long finger 66, ring finger 67, and small finger 68, respectively, are absent of padding. Preferrably, longitudinally extending pad 115 extends along the thumb side of the index finger 65 thereby connecting first pad portion 114 with second pad portion 116 along the metacarpalphalangeal joint 37. As shown, the U-shaped pad 112, including the first pad portion 114 and the second pad portion 116, is of unitary construction. As best shown in FIG. 3, the padding 114 and 116 extends above the knuckle area of the fingers so that in a bent condition the padding surrounds the knuckle but does not interfere with the bending movement and flexibility of the center axis of rotation of the metacarpalphalangeal joints of the fingers with an open end distal to the little finger 56. Also as shown in FIG. 2 is a third pad 118 which is provided along the proximal phalanx 41 of the thumb 64 below the interphalangeal joint 46 and above the metacarpalphalangeal joint 36 so that the joints 36 and 46 are absent of padding and therefore minimizes interference with movement and flexibility of the thumb.

Shown in FIG. 6 is another preferred embodiment of the present invention wherein the pad to protect the knuckle areas of the hand is of unitary construction as identified by the numeral 212. A first pad portion 214 is positioned to cover the same areas of the finger as the pad 114 as shown in FIG. 2 and the second pad portion identified by the numeral 216 is positioned to cover the same areas of the dorsal side of the hand as the second pad portion 116 in FIG. 2. Again, the center axis of rotation of the metacarpalphalangeal joints 37, 38, 39 and 40 are free of padding therefore providing relatively free movement of the knuckles. However, padding is provided between the center axis of rotation of the metacarpalphalangeal joints 37, 38, 39 and 40 to provide additional protection to the areas between the knuckles of each finger. The additional padding identified by the numeral 220 is positioned between the metacarpalphalangeal joints 37 and 38 whereas the padding 222 is positioned between the metacarpalphalangeal joints 38, 39 and padding identified by the numeral 224 is positioned between the metacarpalphalangeal joints 39 and 40. As shown, the pads 220, 222, 224 include ring shaped cut-outs surrounding each joint of each finger. Also, as shown in FIG. 6 a third pad 218 of oval construction is positioned to surround the center axis of rotation of the metacarpalphalangeal joint 36 of the thumb.

Shown in FIG. 7 is even another preferred embodiment of the present invention wherein the pad to protect the knuckles area of the hand includes generally U-shaped pad 312 with a first pad portion 314 and a second pad portion 316 which covers the same areas of the fingers as the pad 112 as shown in FIG. 2. The padding 312 is configured to include padding between the metacarpalphalangeal joints of the fingers also. Additionally, padding shown as U-shaped pads 330, 332, 334, and 336 are provided to protect the proximal interphalangeal joints 47, 48, 49 and 50 of the index finger, long finger, ring finger, middle finger and small finger, respectfully. U-shaped pads 330, 332, 334 and 336 are positioned to cover the distal end of the proximal phalanxes 42, 43, 44 and 45 and the proximal end of the middle phalanxes 52, 53, 54 and 55 with the absence of padding over the proximal interphalangeal joints 47, 48, 49 and 50. A generally U-shaped pad 340 is also provided to circumscribe the metacarpalphalangeal joint 36 of the thumb. Additionally, pad 318 is provided along the inside of the proximal phalanx 41 of the thumb 64. The pad 318 is positioned below the interphalangeal joint 46 and above the metacarpalphalangeal joint 36 of the thumb 64. Even further, a U-shaped pad 342 is provided to circumscribe the distal radio ulnar joint 22 of the wrist area of the hand.

Also in FIG. 7 an expansion motion zone 350 is provided to include additional flexibility in the use of the glove. Motion zone 350 includes an area extending along the inside of the glove between the thumb 64 and the index finger 65 to the wrist area. A thin strip of flexible material or webbing is generally provided in the area identified by the numeral 350 which enables easy expansion and movement of the thumb when in a use condition.

The detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A glove comprising:

A covering for a human hand with separate elongated sections to receive a plurality of fingers therein, said covering having a top portion for covering a dorsal side of the hand including said elongated sections to receive a plurality of fingers, and, a lower portion to cover a palm side of a hand including a bottom side of said elongated section to receive said plurality of fingers and said thumb; and, a first pad positioned in said top portion overlying a plurality of metacarpals of the plurality of fingers for location below the center axis of rotation of the metacarpalphalangeal joints of the plurality of fingers and a second pad positioned along said top portion of said covering overlying a plurality of proximal phalanxes of the plurality of fingers for location above the center axis of rotation of the metacarpalphalangeal joints of the plurality of fingers whereby said first and said second pads are positioned on opposed sides of knuckles of a human hand, said covering at said metacarpalphalangeal joints being absent of padding.

2. The glove of claim 1 including a third pad extending along the inside of the proximal phalanx of the thumb below the interphalangeal joint of the thumb and above the center axis of rotation of the metacarpalphalangeal joint of the thumb, said interphalangeal joint and said metacarpalphalangeal joint being absent of padding.

3. The glove of claim 1 including a padding circumscribing the metacarpalphalangeal joint of the thumb.

4. The glove of claim 1 wherein said first and said second pad are of unitary construction.

5. The glove of claim 1 wherein said first and said second pads are thicker than knuckles of a hand in a closed condition.

6. The glove of claim 1, said first and said second pads being of unitary construction with a ring shaped cut-out surrounding each metacarpalphalangeal joint of each finger.

7. The glove of claim 1 including padding above and below the center axis of rotation of the proximal interphalangeal joints of the fingers.

8. The glove of claim 1 including an expansion zone of a flexible material extending between the thumb and index finger of the glove to the wrist area of the hand.

9. The glove of claim 1 wherein said first and said second pads are in a substantially spaced parallel relationship.

10. The glove of claim 9 including a longitudinally extending pad positioned to be between said first pad and said second pad.

11. The glove of claim 10 wherein said first longitudinally extending pad is positioned to be along the thumb side of an index finger.

* * * * *